US006462652B1

(12) United States Patent
McCuen et al.

(10) Patent No.: US 6,462,652 B1
(45) Date of Patent: Oct. 8, 2002

(54) DISTRIBUTED VERIFICATION, CONFIRMATION OR DELAY TIME SYSTEM AND METHOD

(75) Inventors: Steven W. McCuen, Saratoga, CA (US); Dominick A. Testa, St. Charles, IL (US)

(73) Assignee: Pittway Corporation, St. Charles, IL (US)

( * ) Notice: Subject to any disclaimer, the term of this patent is extended or adjusted under 35 U.S.C. 154(b) by 31 days.

(21) Appl. No.: 09/795,748

(22) Filed: Feb. 28, 2001

(51) Int. Cl.[7] ..... G08B 23/00; E05B 45/06

(52) U.S. Cl. ..... 340/501; 340/506; 340/514; 340/528; 340/542; 340/3.1; 70/263

(58) Field of Search ..... 340/501, 505, 340/506, 514, 527, 528, 3.1, 542, 331, 332; 70/263, 264

(56) References Cited

U.S. PATENT DOCUMENTS 4,162,488 A * 7/1979 Silverman et al. ..... 340/505
4,465,904 A 8/1984 Gottsegen et al. ..... 340/539
4,581,606 A 4/1986 Mallory ..... 340/539
4,652,862 A * 3/1987 Verslychken ..... 340/540
4,737,770 A 4/1988 Brunius et al. ..... 340/539
4,737,771 A 4/1988 Coash ..... 340/539
5,325,084 A * 6/1994 Timm et al. ..... 340/541
5,736,927 A 4/1998 Stebbins et al. ..... 340/539

* cited by examiner

*Primary Examiner*—Donnie L. Crosland
(74) *Attorney, Agent, or Firm*—Welsh & Katz, Ltd.

(57) ABSTRACT

A multi-unit monitoring system includes a plurality of units coupled to a communication medium. The system can also incorporate a common control element coupled to the medium. The individual units include control circuitry which is capable of carrying out verification, confirmation, or entry/exit delay processing. While the control element can receive messages from the various units indicative of their status, the units themselves carry out the respective timing functions.

22 Claims, 2 Drawing Sheets

FIRE-12i
ALTHi
12i-S
T1
T2
T3
T4
t
12i MESSAGES
VW1
VW2
Mi-1
Mi-2
Mi-3
Mi-4
FIRE-12j
ALTHj
12j-S
T5
12j MESSAGE
Mj-1

DISTRIBUTED VERIFICATION, CONFIRMATION OR DELAY TIME SYSTEM AND METHOD

FIELD OF THE INVENTION

The invention pertains to multiple unit peer-to-peer event detection systems. More particularly, the invention pertains to such systems wherein the units locally carry out, alone or in combination, alarm verification, event confirmation or delay processes.

BACKGROUND OF THE INVENTION

Multi-detector monitoring and alarm systems are used to monitor a region for one or more conditions of interest. Known types of conditions include fire, gas, intrusion and the like.

Known systems often incorporate a common control element which is coupled to a plurality of detectors by some form of a bidirectional communication medium. The medium can be wired, electrical or optical, or wireless, infra-red or RF, for example.

It is recognized that false alarms in such systems are undesirable. One known way of reducing false alarms is by carrying out an alarm verification process at the control element. Where a detector senses an ambient condition, such as fire or smoke, above an alarm threshold, the control element receives this information and waits a predetermined period of time without initiating an alarm condition. A temporal window is then initiated during which additional indications of fire from the same or a different detector will cause an immediate system alarm.

Alternately, some of the known systems use a confirmation process. The control element, upon receipt of an alarm indicating signal from a detector, immediately establishes a confirmation window. The detector must continuously exhibit the alarm condition throughout the confirmation period for the control element to accept the signal as indicating a valid alarm condition.

In yet another application, access control systems incorporate entry and exit time delays to permit normal premises entries and exits without causing alarms. In known systems, a common control element receives signals from transducers, for example, switches, indicative of the opening and/or the closing of doors to or from controlled areas.

In known systems, a common control element generates a premises entry delay upon receipt of an entry signal. The delay is provided to enable a legitimate entrant into the region to reset the access monitoring system thereby forestalling the generation of an unnecessary or false alarm.

Known systems also provide an exit delay. A user signals a common control element as to an imminent exit from the monitored region. The control element initiates an exit delay window during which the individual is permitted to exit from the premises without having the control element initiate an alarm.

In known systems, the common control element receives communications from the system detectors and that element carries out the verification, confirmation, or entry/exit delay timing. It would be useful and promote efficiency in such systems if the respective detectors were able to carry out their own timing processes. In such instances, it would be unnecessary for the respective detectors to communicate with the common control element so that that element could then carry out all of the steps of the respective timing function. System overhead could thus be reduced by providing the various detectors with local control over their respective timing processes.

Known systems incorporate hundreds, sometimes thousands, of detectors. Implementing verification, confirmation or delay processing at the common control element in such systems can create significant system overhead and absorb significant hardware resources and processing time. There, as a result, is a continuing need for monitoring systems which will provide comparable functionality in a more effective fashion so as to reduce overhead and provide improved response.

SUMMARY OF THE INVENTION

A multi-unit monitoring system includes a plurality of units coupled to a communication medium. Individual units can carry out verification, confirmation or delay processing.

A unit can incorporate an ambient condition sensor of fire or airborne gas. Where local processing at a unit indicates a possible alarm condition, the unit enters a verification mode and waits a predetermined period of time. A predetermined verification period follows. If the respective unit indicates an alarm condition during the verification period, it will immediately enter an alarm state. It can also, at that time, transmit an alarm indicating message to other units.

If the respective unit does not indicate an alarm condition during the verification period, the predetermined period of time is reset. Optionally, a status indicating message can be transmitted to the other units.

Multiple units can cooperate in the verification process. When one unit enters the verification mode, it can send a status message to other units. If one of the other units, which has received the status message, detects a possible alarm condition, that unit or units can immediately go into an alarm state. Alternately, if the receiving unit is already in a verification mode when it receives the status message, it can terminate that mode and immediately enter an alarm state.

By carrying out the verification process locally, the common control element, if present, need not devote resources to the process. Even if the control element keeps track of status messages from various units, this will still represent less overhead than that required in implementing the verification process for all of the units, which could number in the hundreds or thousands.

In yet another embodiment, electrical units can carry out a confirmation process. Where a sensor associated with the unit exhibits a change of state, a confirmation time interval is locally initiated. A status message indicating entry to a confirmation mode can be sent to other units. A change of state message is not sent unless that change of state persists through the entire confirmation time interval. However, where the change of state has extended through the entire interval, a change of state indicating message will be sent at the end of that interval.

In one embodiment, local confirmation can be incorporated into a fire detector, for example. Entry into a state indicative of a possible alarm triggers the confirmation interval. If the respective fire sensor stays in that state throughout the confirmation interval, an alarm message can be sent from the unit at the end of the interval. If the sensor returns to a quiescent state, the time interval is terminated and no alarm message will be sent. In this embodiment, local confirmation will help suppress nuisance alarms.

In yet another embodiment, one or more units can carry out delay processing. When used to control access, for example, a unit that detects an entry into a region delays initiating an alarm for a predetermined period of time. If during this period, the unit is reset, for example using a key card, manual entry of an access code or the like, no alarm signal will be issued. If not reset an alarm will be issued after the time interval has passed.

In another aspect, an exit delay can be provided locally. An individual about to leave a controlled region can signal this intent to a local access control unit by key card, key pad or the like. In response thereto, an exit delay is locally initiated. An optional status message can be sent by the local unit.

No alarm signal will be generated provided an exit from the region takes place during the exit delay interval. Another status message can be sent at the time the exit is sensed, or, at the end of the delay interval.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 3-1 through 3–4 are a series of timing diagrams which taken together illustrate verification processing in accordance with the present invention.

DETAILED DESCRIPTION OF THE PREFERRED EMBODIMENTS

Figure 1:
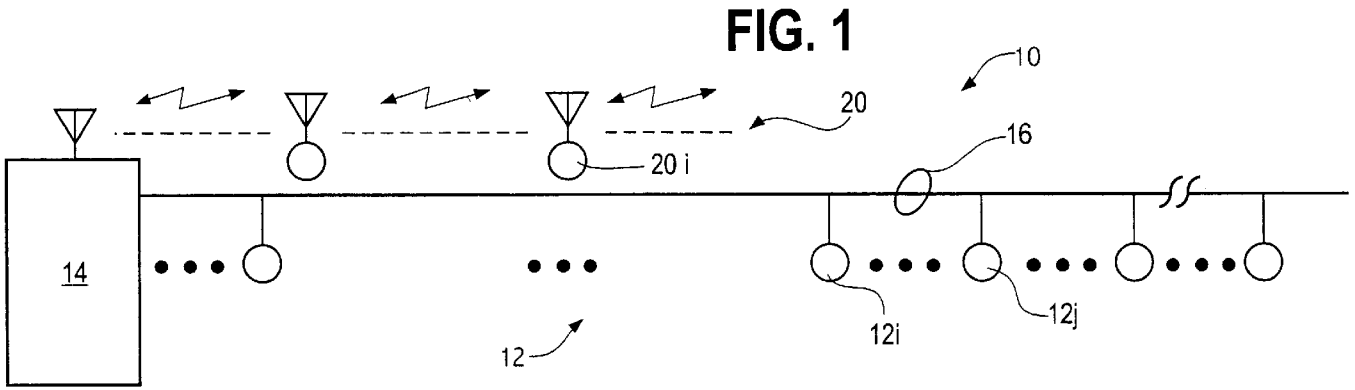
FIG. 1 is a block diagram of a multiple unit monitoring system in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates monitoring system 10 in accordance with the present invention. The system 10 includes a plurality of electrical units which includes a plurality of ambient condition detectors 12 coupled to an exemplary control element 14 via a bidirectional communications link 16. The link 16 can be an optical or an electrical cable.

Additionally, system 10 can incorporate a plurality of detectors 20 which are in wireless communication with one another and with the control element 14. It will be understood, as discussed below, that the units in pluralities 12 and 20 can function in a peer-to-peer mode independently of control element 14 which can, but need not, be present.

Figure 2:
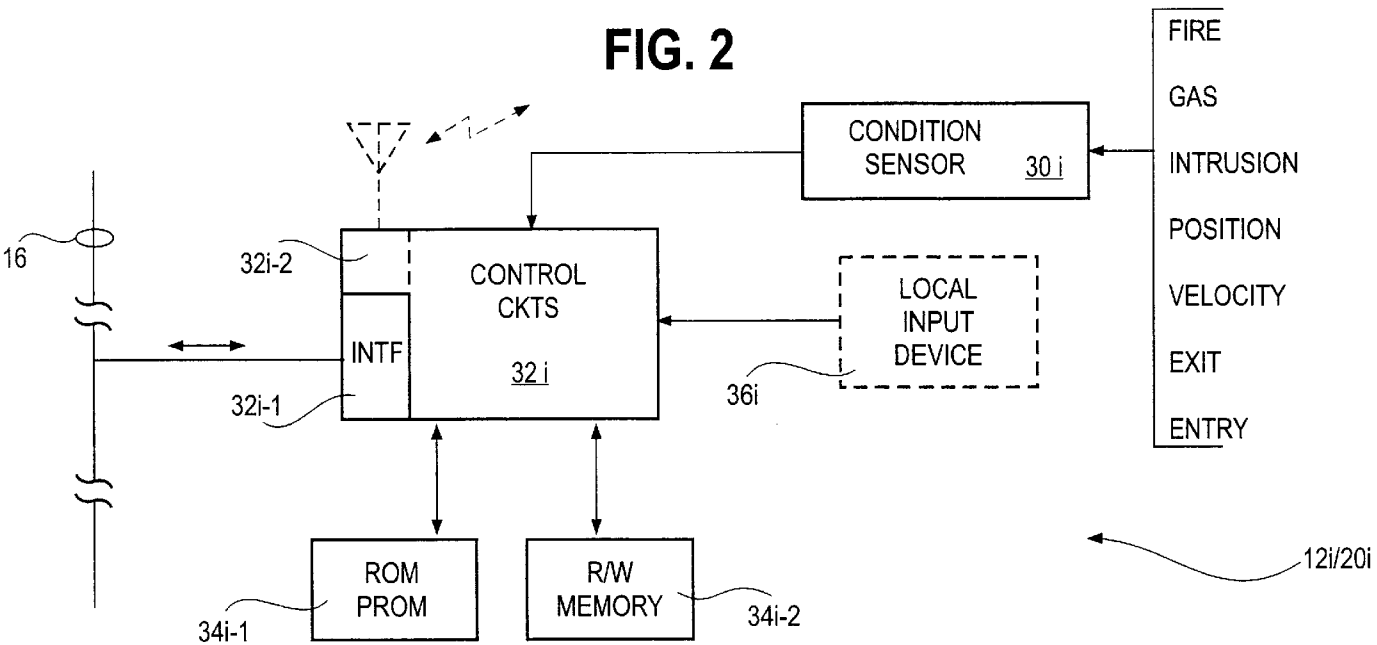
FIG. 2 is a block diagram of a representative unit usable in the system of FIG. 1.

FIG. 2 illustrates in block diagram form a representative member of the pluralities 12 and 20, detector **12*i*/20*i*. Detector 12*i*/20*i* includes at least one ambient condition sensor 30*i* which could be implemented as a fire sensor, a gas sensor, an intrusion sensor, a position sensor, a velocity sensor, an exit sensor or an entry sensor. Combinations of sensors come within the scope and spirit of the present invention. The sensor 30*i* is coupled to control circuitry 32*i*** which could be implemented, at least in part, with a programmed processor.

Executable instructions and parameters can be stored in read-only memory or programmable read-only memory **34*i*-1. Read-write memory 34*i*-2 can be used for carrying out on-going message processing, processing of signals from the detector 30*i*** or the like.

Control circuits **32*i* are in bidirectional communications with medium 16 via interface circuitry 32*i*-1. Additionally, with respect to the members of the plurality 20, the control circuits 32*i* are in wireless communication with each other and control element 14 via interface circuitry and antenna 32*i*-2**.

Figures 1, 2, 3, 4:
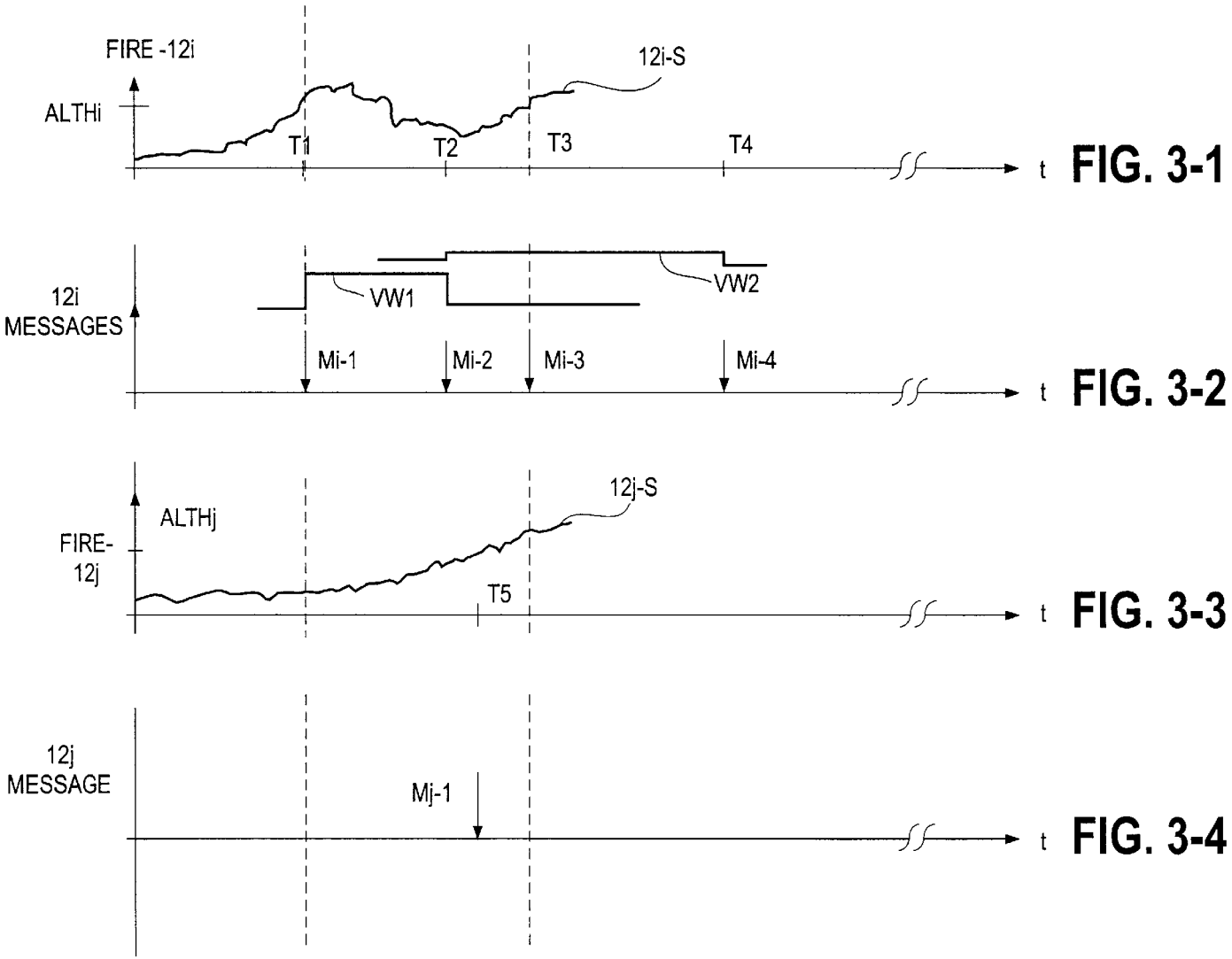

The members of the plurality 12 or 20 or both can carry out local confirmation processing in response to signals from the local ambient condition sensor, such as the sensor **30*i*. FIGS. 3-1 through 3–4** illustrate timing diagrams and examples of single detector/multiple detector verification processing.

The following discussion of FIG. 3 is with respect to a member of plurality 12 or plurality 20, such as detector **12*i* and detector 12*j***, both of which can be implemented as fire detectors. The type of detector is not a limitation of the present invention.

With respect to detector **12*i*, FIG. 3-1 illustrates an output signal 12*i*-S from the respective fire sensor 30*i*** as it responds to a local fire indicating condition such as flame, smoke or temperature. As is known to those of skill in the art, such signals will vary with time. An increase in such a signal or signals may, but is not always, indicative of a developing fire.

At time T1, the signal from sensor **30*i*** has crossed a pre-established alarm threshold ALTHi. In the present example, crossing this threshold is deemed indicative of the existence of a potential developing fire condition.

It will be understood that other forms of local alarm processing such as rate of change or profile processing, to evaluate an alarm condition, could be used without departing from the spirit or scope of the present invention.

In response to a potential alarm condition, control circuits **32*i* initiate a local, first, verification window VW-1, but do not generate an alarm indicating message. However, an alarm verification start message M*i*-1 can be communicated along the members of the plurality 12 via medium 16 or among the members of the plurality 20** wirelessly.

Message **M*i*-1 alerts other detectors or units in the system to the fact that detector 12*i* has detected a possible alarm condition. When the preset interval VW-1 ends at time T2, the detector 12*i* can generate and transmit to other detectors or units in the system a status indicating message M*i*-2. At the same time, a second verification window VW-2, of a predetermined duration is initiated by the control circuits 32*i*. This window, or interval lasts until time T4**.

In the event that output **12*i*-S from sensor 30*i*, detector 12*i*, which has decreased, increases and re-crosses the alarm threshold at time T3, detector 12*i* will immediately enter an alarm state and transmit a message, M*i*-3 indicative of its alarm state. On the other hand, if detector 12*i* never re-enters an alarm state, it can at time T4, when interval VW2 ends, issue an alarm verification end or stop message M*i*-4. This message indicates to other detectors or units in the system that the second time interval VW-2** has expired without the fire indicating condition being sensed again.

In the event that signal **12*i*-S never recrosses the alarm indicating threshold ALTHi during window VW-2, it may not have indicated a valid alarm condition at time T1. In this instance, the local alarm verification processing has avoided generating a false alarm without using processing resources in control element 14**.

Alternately, detectors **12*i* and 12*j* can cooperate in carrying out the verification processing. Where a detector 12*i* has issued an alarm verification start message M*i*-1 at time T1, and such message has been received by one of the members of the plurality 12, such as detector 12***j*, that detector can dispense with the initial period or window VW-1. Instead, the control circuits 32*j* can enter a pre-alarm state. In this state if the local sensor 30j exhibits an output signal 12*j*-S which crosses its alarm threshold ALTHj at time T5, detector 12*j* can immediately go into alarm at time T5 thereupon immediately issuing alarm indicating message M*j*-1. In this example, the alarm indicating message M*j*-5 has been issued sooner than was the alarm indicating message M*i*-3 from detector 12*i*.

The following examples illustrate various combinations and possibilities of alarm verification processing.

Alarm verification Example 1

(Smoke detector i is programmed for alarm verification)

Detector i alarm threshold ALTHi exceeded at time T1;

Detector i initiates initial alarm verification window VW-1 and;

Detector i sends alarm verification window start message M*i*-1;

Detector i smoke level drops below alarm threshold;

Detector i concludes initial window phase, starts second verification window VW-2 at time T2;

Detector i alarm threshold exceeded again; and detector i sends immediate alarm message MI-3 at time T3;

Detector i concludes alarm verification process with a final status message at time T4.

Result: Alarm was issued immediately after a second transient smoke condition occurred during the second verification window.

Alarm verification Example 2

(Smoke detector i is programmed for alarm verification, detector j is not)

Detector j alarm threshold exceeded;

Detector j sends immediate alarm message received by detector i;

Detector i alarm threshold exceeded, because detector i previously received detector j's alarm message;

detector i bypasses alarm verification processing and sends immediate alarm message.

Result: 2 alarms were issued, alarm verification was bypassed on detector i because it was aware of the alarm condition on detector j. This multi-detector process did not require any involvement of the control element 14.

Alarm verification Example 3

(Smoke detector i and j are programmed for alarm verification)

Detector i alarm threshold exceeded and detector i initiates initial alarm verification window VW-1;

Detector i sends alarm verification window VW-1 start message;

Detector i concludes initial phase, starts second verification window VW-2 at T2;

Detector j alarm threshold exceeded, because detector previously received detector i's alarm verification window start message, detector j bypasses alarm verification process and sends immediate alarm message;

Detector i sends alarm message.

Result: Alarm issued by detector j. Alarm verification was bypassed on detector j because it was aware of the alarm condition on detector i. Second alarm message was issued by detector i.

Alarm verification Example 4

(Smoke detectors i and j are programmed for alarm verification)

Detector i alarm threshold exceeded

Detector i initiated alarm verification window VW-1;

Detector i sends alarm verification window VW-1 start message;

Detector i concludes initial phase, starts second verification window VW-2 at time T2;

Detector j alarm threshold exceeded

Detector j bypasses alarm verification and sends alarm message (because detector j previously received detector i's alarm verification window VW-1 start message);

Detector i sends alarm message (because detector i received detector j's alarm message);

Detector i terminates alarm verification process

Result: Two alarms were issued, alarm verification was bypassed on both detectors because each was aware of the condition of the other.

Table 1 summarizes detector behavior in response to various conditions:

TABLE 1

| Detector | Composite State On Communication Link | | | |
|---|---|---|---|---|
| Current state | All normal | Verify start | Verify stop | Alarm |
| Normal | No Action | No action | No action | No action |
| Alarm threshold exceeded | Start alarm verification, send verify start message | Bypass alarm verification, send alarm message | Start alarm verification, send verify start message | Bypass alarm verification, send alarm message |
| In verify process | Continue verify process | Bypass alarm verification, send alarm message | Not possible | Bypass alarm verification, send alarm message |

Confirmation processing attempts to locally minimize false alarms by incorporating a single programmable, confirmation time period into a device such as a fire or a gas detector. A change of state in the device in response to a signal received from a local sensor, (normal to alarm, alarm to normal, etc) initiates this time period.

If the new state remains stable and does not change for the duration of the time period in response to the signal staying in an alarm state, the device accepts the new state as validly indicating an alarm condition. The device then transmits an alarm state indicating a message.

If the signal from the sensor ceases exhibiting an alarm condition at any time during the confirmation time period, device will revert back to its original state and the timer will be cancelled. If the device changes to another state during the time period, the timer is restarted.

Confirmation Example 1

Device changes from normal to alarm;

Device confirmation time interval is initiated;

Device changes from alarm to normal;

Device confirmation time interval is reset.

Result: No alarm message generated because the alarm condition did not last as long as the confirmation time.

Confirmation Example 2

Device changes from normal to alarm;

Device confirmation time interval is initiated;

Device confirmation time interval expires;

Device sends alarm message.

Result: Alarm message generated because the alarm condition lasted longer than the confirmation time.

Entry/exit processing attempts to locally minimize inappropriate ingress and egress redated alarms. Entry delay and exit delay functionality can be implemented in security devices using two programmable time intervals.

FIG. 2 illustrates a door access control unit, such a unit 12*i* where the sensor 30*i* monitors the state of a door, open or closed, for example. Local input device 36*i*, illustrated in phantom in FIG. 2, could be a card reader, key pad or the like that a user can use to arm or disarm the unit and/or control system. Alternately, an input device at control element 14 can be used.

An entry delay permits a user to violate a security point of an armed system without causing an alarm. The violation, for example opening a door, starts the entry delay interval.

As long as the system switches from armed to disarmed status before the time period expires, no alarm is generated. Once a valid user opens the armed door and enters the region, input device 36*i* can be used to enter an authorizing code and disarm the unit, and/or system. It will be understood that the system arming device could also be located at unit 14. In this instance, someone entering the region, before or after opening the door, can call an operator who can enter an appropriate code at element 14.

Exit delay permits a user to arm a security system and then violate a security point, open a door, without causing an alarm. As long as the violation occurs within the exit time period and restores, door closes, before the time expires, no alarm is generated.

Entry delay Example 1

System is previously armed and sent armed status message to all devices in system

- Device 12*i* monitoring entry door is violated (door is opened);0
- Device entry timer is started;
- User goes to control device 36*i* (or some other selected device) and disarms system;
- Device 12*i* sends disarmed status message to all devices in system;
- Device 12*i* terminates entry timer, no alarm is generated.

Entry delay Example 2

System is previously armed and sent armed status message to all devices in system

- Device 12*i* monitoring entry door is violated (door is opened);
- Device entry timer is started;
- Device entry timer expires;
- Device sends out alarm message.

Exit delay Example 1

System is previously disarmed and sent disarmed status message to all devices in system

- System armed at control device 36*i* or other selected device, such as unit 14;
- Armed status message sent to all system devices;
- Device monitoring selected door starts exit timer;
- Device monitoring selected door is violated;
- Device monitoring entry door is restored;
- Device exit timer expires, no alarm generated; and system remains in armed mode.

Exit delay Example 2

System had been previously disarmed and sent disarmed status message to all devices

- System armed at control device 36*i* or unit 14;
- Armed status message sent to all devices;
- Device monitoring selected door starts exit timer;
- Device exit timer expires;
- Device monitoring selected door is violated;
- Device sends out alarm message; and system remains in armed mode.

It will be understood that the above described processing is preferably implemented locally at the respective devices 12*i*, 20*i*. In addition, preferably the processing is carried out, at least in part, by executable instructions stored in the respective device(s) and executed by the processor in the respective control circuits 32*i*.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed is:

1. A system comprising:

a communication link;

a plurality of electrical units coupled to the link wherein at least some of the units each include an event sensor and event tracking circuitry coupled to the sensor, wherein in response to a sensed event, the circuitry at the respective unit establishes an event tracking process at the respective unit and transmits via the link a first status message indicative thereof and whereby an event indicating message signifying the occurrence of that event is sent by the respective unit only where one of, the event is sensed at the end of the tracking process; and, the event was continuously sensed during the tracking process has occurred.

2. A system as in claim 1 wherein at least one of the at least some of the units includes circuitry for sensing a tracking process initiation message transmitted from another unit via the link.

3. A system as in claim 2 wherein the message alters the event tracking process executed at the receiving unit.

4. A system as in claim 1 wherein the tracking circuitry at the respective unit initiates a time interval in response to the sensed event and wherein the tracking circuitry comprises circuitry for determining if the event is sensed at the end of the time interval, and in response thereto transmits the event indicating message.

5. A system as in claim 4 wherein the circuitry determines if the event has been continuously sensed during the time interval, and in response thereto, transmits the event indicating message.

6. A system as in claim 4 wherein the circuitry initiates a second time interval, at the end of the time interval and wherein the tracking circuitry transmits the event indicating message where the sensed event occurs during the second time interval.

7. A system as in claim 1 wherein, at least some of the units include circuitry for processing messages from other units, whereby a unit which has received a first status message, via the link, subsequent to having initiated an event tracking process includes executable instructions for immediately transmitting an event indicating message to other units via the link.

8. A system as in claim 7 wherein at least some of the units include executable instructions for sending the first status message, detecting an event indicating message from another unit and instructions for sending another event indicating message.

9. A system as in claim 7 wherein the event sensor comprises at least one of a fire sensor and a gas sensor.

10. A multi-unit system;

a communications link;

a plurality of electrical units coupled to the link wherein selected of the units each include circuitry responsive to a sensed condition to initiate at least one time interval; and control circuitry at each of the selected units, responsive to one of, the presence of the condition continuously during the interval, and, the presence of the condition at any time during a contiguous subsequent interval whereupon the control circuitry generates a respective indicator.

11. A system as in claim 10 wherein the respective indicator is coupled to the link.

12. A system as in claim 10 wherein the respective indicator comprises a change of state of the respective control circuit.

13. A system as in claim 10 wherein at least some of the selected units each include executable instructions for responding to received status messages from other units wherein the messages are indicative of having initiated the at least one time interval.

14. A system as in claim 13 wherein the respective executable instructions, in response to a local sensed condition, subsequent to at least one received status message, immediately enter an alarm indicating state.

15. A system as in claim 14 wherein the respective instructions couple an alarm state indicating message to the link.

16. A peer-to-peer monitoring system comprising:

a communications link;

a plurality of electrical units coupled to the link wherein members of a first group of the units each include a fire sensor and wherein the members of the first group are substantially identical and each includes executable instructions for initiating a first interval in response to a locally sensed fire condition and instructions for transmitting, via the link, an interval initiating status message to other electrical units wherein other members of the first group include executable instructions for receiving the status message and in response thereto, upon sensing a local fire condition, enter an alarm state and transmit an alarm state message via the link to other units whereby, any unit which had emitted an interval initiating status message in response to a received alarm state message, executes instructions to emit another alarm sate message via the link.

17. A monitoring system as in claim 16 wherein members of a second group of electrical units are substantially identical and each includes a door position sensor wherein the members of the second group include executable instructions, responsive to a change of state of the sensor, to initiate one of, an entry delay and an exit delay.

18. A monitoring system as in claim 17 which includes at least one manually operable access control data entry device.

19. A monitoring system as in claim 17 wherein the members of the second group include executable instructions for receiving a user authorizing code at one of, after initiation of an entry delay and before initiation of an exit delay, and for responding thereto by not initiating an alarm where the code was received at one of, before termination of the entry delay and prior to initiation of the exit delay.

20. A door access control comprising:

a door unit having a door location sensor for a respective door wherein the door unit is coupled to a local control circuit;

a manually operable input unit coupled to the control circuit for entering one of an entry indicator and an exit indicator whereupon executable instructions in the control circuit temporarily enter an exit state, for a predetermined time interval, permitting an exit via the respective door without entering an alarm state in response to a received exit indicator with other instructions, in response to the sensor signaling an entry via the respective door, temporarily entering into an entry state for a predetermined time interval thereby providing a time interval for receipt of an entry indicator and not entering an alarm state wherein the control circuit exits the respective state, after the respective time interval.

21. A door access control as in claim 20 which includes a plurality of the door units, wherein the units are spaced apart from one another and are coupled by a communication link wherein each of the units includes instructions, executed local to the respective sensor, to locally establish an entrance delay and an exit delay.

22. A door access control as in claim 21 wherein at least some of the units include a local audible alarm and circuitry for energizing same in the event of an entrance or an exit wherein the respective entry indicator or exit indicator had not been properly entered and the respective entry or exit was not sensed during the respective predetermined time interval.

* * * * *